US007665437B2

(12) United States Patent
Hashimoto

(10) Patent No.: US 7,665,437 B2
(45) Date of Patent: Feb. 23, 2010

(54) OIL PASSAGE STRUCTURE OF VALVE OPERATING SYSTEM

(75) Inventor: Hiromichi Hashimoto, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 12/158,768

(22) PCT Filed: Jun. 1, 2007

(86) PCT No.: PCT/IB2007/001428

§ 371 (c)(1),
(2), (4) Date: Jun. 23, 2008

(87) PCT Pub. No.: WO2007/141612

PCT Pub. Date: Dec. 13, 2007

(65) Prior Publication Data

US 2008/0264366 A1 Oct. 30, 2008

(30) Foreign Application Priority Data

Jun. 6, 2006 (JP) ..... 2006-157452

(51) Int. Cl.
*F01M 1/06* (2006.01)

(52) U.S. Cl. ..... 123/90.34; 123/90.38; 123/90.52; 123/90.27

(58) Field of Classification Search ..... 123/90.27, 123/90.31, 90.34, 90.44, 90.6, 90.38, 90.52, 123/90.55
See application file for complete search history.

(56) References Cited

U.S. PATENT DOCUMENTS

| | | | |
|---|---|---|---|
| 6,026,772 | A | 2/2000 | Shirabe |
| 2003/0013362 | A1 | 1/2003 | Fukuda et al. |
| 2004/0211385 | A1 | 10/2004 | Lee |

FOREIGN PATENT DOCUMENTS

| | | | |
|---|---|---|---|
| DE | 197 47 244 | A1 | 4/1999 |
| GB | 2 011 569 | A | 7/1979 |
| JP | 60-32505 | U | 5/1985 |
| JP | 9-273404 | A | 10/1997 |
| JP | 9-291805 | A | 11/1997 |
| JP | 11-182213 | A | 7/1999 |
| JP | 2000-179311 | A | 6/2000 |
| JP | 2000-220420 | | 8/2000 |
| JP | 2000-310156 | A | 11/2000 |
| JP | 2000-328908 | A | 11/2000 |
| JP | 2004-324636 | A | 11/2004 |

OTHER PUBLICATIONS

The new Toyota CROWN GRS18# explanation pages, Dec. 2003.

*Primary Examiner*—Ching Chang
(74) *Attorney, Agent, or Firm*—Sughrue Mion, PLLC

(57) ABSTRACT

In a cam journal (12A) in which a timing-advance oil passage (12*a*) and a timing-retard oil passage (12*b*) are provided as a first oil passage for VVT, an oil passage (102*c*) for HLA is provided as the second oil passage. The timing-advance oil passage (12*a*) and the timing-retard oil passage (12*b*), which are formed on the surface of the intake camshaft (12), are separated from the oil passage (102*c*) for HLA by a lower cam bearing (202). Thus, it is possible to provide the control oil passages for VVT and the oil supply passage for HLA in one cam journal (12A).

8 Claims, 1 Drawing Sheet

OIL PASSAGE STRUCTURE OF VALVE OPERATING SYSTEM

BACKGROUND OF THE INVENTION

1. Field of the Invention

The invention relates to an oil passage structure of a valve operating system for an internal combustion engine, in which an oil passage used for controlling a variable valve timing mechanism is provided in a cam journal for a camshaft.

2. Description of the Related Art

Each of Japanese Patent Application Publications No. 2000-220420 (JP-A-2000-220420), No. 09-273404 (JP-A-09-273404), No. 09-291805 (JP-A-09-291805) and No. 2000-179311 (JP-A-2000-179311) describes invention relating to a variable valve timing mechanism (hereinafter, referred to as "VVT") for an internal combustion engine.

Each of the above-described publications describes an oil passage structure in which control oil passages for VVT are provided in a first cam journal at the front end of a camshaft, and an oil passage for a hydraulic lash adjuster (hereinafter, referred to as "HLA") is provided in a cam journal at the rear end of the camshaft, or at the rear end of a rocker shaft. These oil passages are constituted by oil grooves in the cam journals. Each of the oil grooves is formed using a die-casting die.

It is rational to provide the two control oil passages used for controlling VVT (i.e., a timing-advance oil passage used for advancing a valve timing, and a timing-retard oil passage used for retarding the valve timing) in the first cam journal that is close to a timing pulley (sprocket). Also, the oil passage used for controlling HLA needs to be separated from the oil passages used for controlling VVT. Further, it is difficult to further provide the oil passage used for supplying oil to the intake HLA and/or exhaust LA in the first cam journal. Therefore, the oil passage for the intake HLA and/or exhaust HLA needs to be provided in the other cam journal.

More specifically, because the oil is generally supplied from the main gallery of the engine to the first cam journal through the control passages used for controlling VVT, the oil passage used for supplying the oil to HLA is provided in another cam journal at the rear end of the engine. However, when this oil passage structure is employed, the oil passage that extends in a longitudinal direction of the engine needs to be provided at the rear end side of the engine (cylinder block). This increases the overall length of the engine. Also, there is no enough space in the portion of the first cam journal at the front side of the engine, it is difficult to provide the oil passage for HLA in addition to the two control passages for VVT at the front end side of the engine. When an oil supply passage for an oil jet is provided, the same problem may arise.

When the oil passage for HLA, or the oil passage for the oil jet is provided in addition to the control oil passages for VVT, the oil passage that extends in the longitudinal direction needs to be provided at the rear end side of the engine (cylinder block). This increases the overall length of the engine. This is the problem to be solved by the invention.

SUMMARY OF THE INVENTION

The invention provides an oil passage structure of a valve operating system for an internal combustion engine, which makes it possible to provide an oil supply passage for HLA or an oil supply passage for an oil jet in addition to a control oil passage for VVT, without increasing the overall length of the engine.

A first aspect of the invention relates to an oil passage structure of a valve operating system for an internal combustion engine, in which an oil passage used for controlling a variable valve timing mechanism is provided in a cam journal for a camshaft. The camshaft is axially supported by an upper cam bearing and a lower cam bearing in the cam journal. In the cam journal in which a first oil passage used for controlling the variable valve timing mechanism is provided, a second oil passage for HLA or an oil jet is provided. The first oil passage is separated from the second oil passage by the lower cam bearing.

According to the first aspect, in the cam journal in which the first oil passage used for controlling the variable valve timing mechanism is provided, the second oil passage for HLA or the oil jet is provided. The first oil passage is separated from the second oil passage by the lower cam bearing. Therefore, it is possible to provide the oil passage used for controlling the variable valve timing mechanism, and the oil passage for HLA or the oil jet in one cam journal.

As a result, it is possible to house the oil passage used for controlling the variable valve timing mechanism, and the oil passage for HLA or the oil jet in a bearing portion that has the same width as that of a bearing portion in which the oil passage used for controlling the variable valve timing mechanism can be housed. Also, the oil passage that extends in the vertical direction needs not be separately provided at the rear end side of the engine (cylinder block) as the passage for HLA or the oil jet. Therefore, it is possible to provide the oil passage for HLA or the oil jet, while maintaining the current size of the engine.

BRIEF DESCRIPTION OF THE DRAWINGS

The above and other objects and features of the present invention will become apparent from the following description of preferred embodiment, given in conjunction with the accompanying drawings, in which.

DETAILED DESCRIPTION OF THE EXAMPLE EMBODIMENTS

Figure 1:
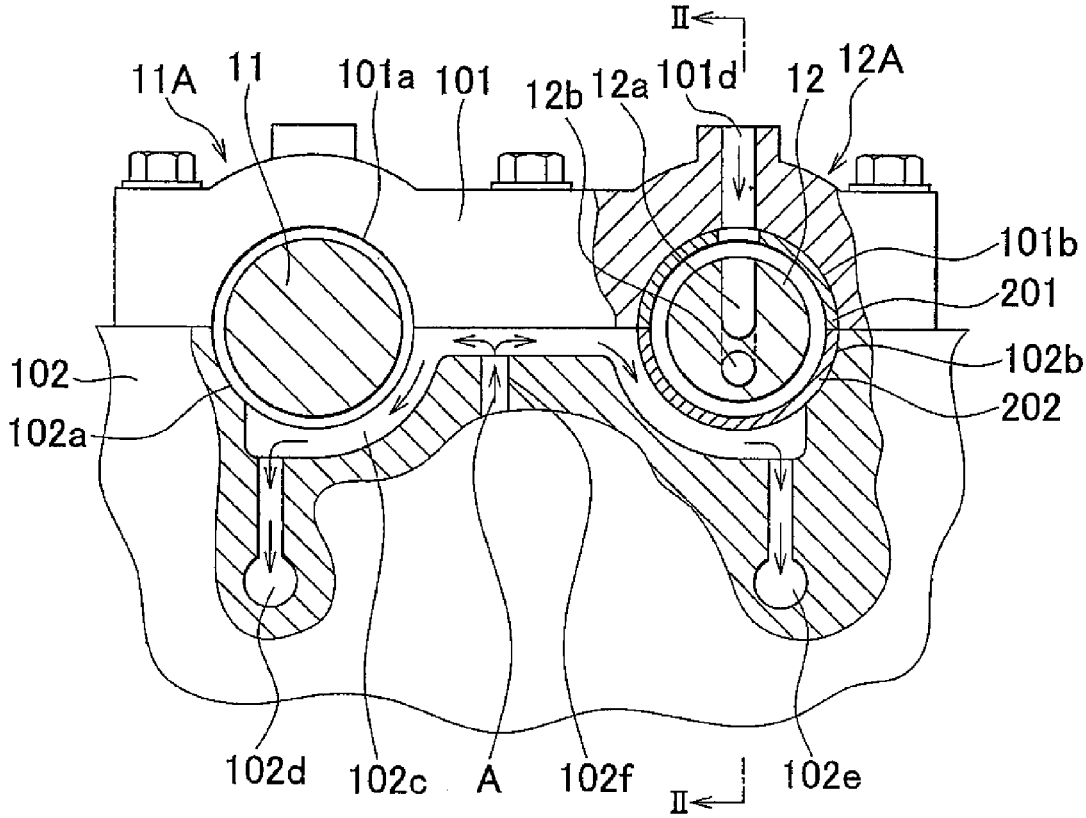
FIG. 1 is a partial cross sectional view showing the cross section structure of a first cam journal according to an embodiment of the invention.
Figure 2:
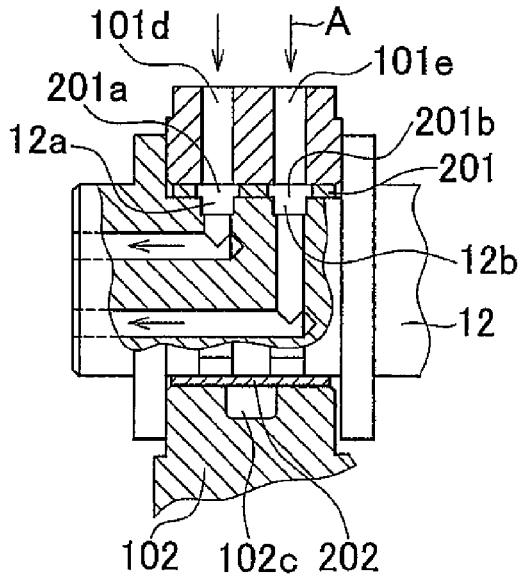
FIG. 2 is a cross sectional view taken along the line II-II in FIG. 1.

Hereinafter, an oil passage structure of a valve operating system for an internal combustion engine according to an embodiment of the invention will be described with reference to FIG. 1 and FIG. 2. FIG. 1 is a partial cross sectional view showing the cross section structure of a first cam journal. FIG. 2 is a cross sectional view taken along the line II-II in FIG. 1. In the oil passage structure of the valve operating system described below, the configuration according to the invention is applied to a cam journal 12A that supports an intake camshaft 12. However, the same configuration may be employed for a cam journal 11A that axially supports an exhaust camshaft 11.

As shown in FIG. 1, the cam journal 11A and the cam journal 12A are provided in the upper portion of a cylinder head 102. The cam journal 11A axially supports the exhaust camshaft 11. The cam journal 12A axially supports the intake camshaft 12. In the cam journal 11A the exhaust camshaft 11 is sandwiched between a semi-circular journal portion 101*a* provided in a cam cap 101, and a semi-circular journal portion 102*a* provided in the cylinder head 102. In the cam journal 12A, the intake camshaft 12 is sandwiched between a semi-circular journal portion 101*b* provided in the cam cap 101, and a semi-circular journal portion 102*b* provided in the cylinder head 102.

[Configuration of oil supply passages for HLA] In the cylinder head 102, an exhaust-side HLA oil passage 102*d* and an intake-side HLA oil passage 102*e* are provided as oil supply passages for LA (Hydraulic Lash Adjuster). The exhaust-side HLA oil passage 102*d* and the intake-side HLA oil passage 102*e* are connected to a common oil passage 102*c* for HLA. The oil passage 102*c* for HLA is connected to an oil supply passage 102*f* provided in the cylinder head 102. Oil A delivered from an oil pump (not shown) is supplied through the oil supply passage 102*f*. Thus, the oil A is supplied to the exhaust-side HLA oil passage 102*d* and the intake-side HLA oil passage 102*e*.

[Configuration of control oil passages for VVT] In the cam journal 12A that axially supports the intake camshaft 12, control oil passages for VVT are formed. As shown in FIG. 2, a timing-advance oil passage 12*a* for controlling VVT to advance a valve timing, and a timing-retard oil passage 12*b* for controlling VVT to retard the valve timing are provided in the intake camshaft 12. The timing-advance oil passage 12*a* and the timing-retard oil passage 12*b* extend along the periphery of the intake camshaft 12, and extend through the intake camshaft 12 in the axial direction of the intake camshaft 12. The timing-advance oil passage 12*a* and the timing-retard oil passage 12*b* are connected to a timing-advance chamber (not shown) and a timing-retard chamber (not shown), respectively. The timing-advance chamber and the timing-retard chamber are provided inside an intake-side VVT controller provided at the front end portion of the intake camshaft 12.

In the cam cap 101, an oil supply passage 101*d* and an oil supply passage 101*e* are provided. The oil A is supplied to the timing-advance oil passage 12*a* through the oil supply passage 101*d*. The oil A is supplied to the timing-retard oil passage 12*b* through the oil supply passage 101*e*. The oil supply passage 101*d* and the oil supply passage 101*e* are connected to an oil control valve (OCV (not shown)) provided at an upper position.

In the cam journal 12A, the intake camshaft 12 is axially supported by an upper cam bearing 201 and a lower cam bearing 202. As a result, the timing-advance oil passage 12*a* and the timing-retard oil passage 12*b*, which are formed on the surface of the intake camshaft 12, are separated from the oil passage 102*c* for HLA by the lower cam bearing 202. The hydraulic pressure in the timing-advance oil passage 12*a* and the hydraulic pressure in the timing-retard oil passage 12*b* do not influence on the hydraulic pressure in the oil passage 102*c* for HLA. The hydraulic pressure in the oil passage 102*c* for HLA does not influence on the hydraulic pressure in the timing-advance oil passage 12*a* and the hydraulic pressure in the timing-retard oil passage 12*b*. The oil A is supplied to the timing-advance oil passage 12*a* from the oil supply passage 101*d* through a hole 201*a* formed in an upper bearing 201. The oil A is supplied to the timing-retard oil passage 12*b* from the oil supply passage 101*e* through a hole 201*b* formed in the upper bearing 201.

Thus, in the oil passage structure of the valve operating system for an internal combustion engine according to the embodiment, the timing-advance oil passage 12*a* and the timing-retard oil passage 12*b* are provided in the cam journal 12A, as the first oil passage for VVT. In the cam journal 12*a*, the oil passage 102*c* for HLA is provided as the second oil passage. The timing-advance oil passage 12*a* and the timing-retard oil passage 12*b*, which are formed on the surface of the intake camshaft 12, are separated from the oil passage 102*c* for HLA by the lower cam bearing 202. Thus, it is possible to provide the control oil passages for VVT and the oil supply passage for HLA in one cam journal 12A.

As a result, it is not necessary to separately provide an oil passage that extends in a longitudinal direction of the engine at the rear end side of the engine (cylinder block). Therefore, it is possible to provide the oil supply passage for HLA while maintaining the current size of the engine.

In the oil passage structure of the valve operating system for an internal combustion engine, the control passages for VVT and the oil supply passage for HLA are provided in one cam journal. However, the control passages for VVT and an oil supply passage for an oil jet may be provided in one cam journal. Also, in the oil passage structure of the valve operating system, the configuration according to the invention is applied to the first journal. However, the invention may be applied to a journal to which the other number is assigned.

Thus, the embodiment of the invention that has been disclosed in the specification is to be considered in all respects as illustrative and not restrictive. The technical scope of the invention is defined by claims, and all changes which come within the meaning and range of equivalency of the claims are therefore intended to be embraced therein.

The invention claimed is:

1. An oil passage structure of a valve operating system for an internal combustion engine, in which an oil passage used for controlling a variable valve timing mechanism is provided in a cam journal for a camshaft, characterized in that:

the camshaft is axially supported by an upper cam bearing and a lower cam bearing in the cam journal;

in the cam journal in which a first oil passage used for controlling the variable valve timing mechanism is provided, a second oil passage for a hydraulic lash adjuster or an oil jet is provided;

the first oil passage is separated from the second oil passage by the lower cam bearing;

the first oil passage is provided at an inside surface of the lower cam bearing, which is the surface where the camshaft is provided; and the second oil passage is provided at an outside surface of the lower cam bearing.

2. The oil passage structure of the valve operating system according to claim 1, wherein the cam journal is a first cam journal positioned at a front end side of the camshaft.

3. The oil passage structure of the valve operating system according to claim 2, wherein the first oil passage includes a timing-advance oil passage used for controlling the variable valve timing mechanism to advance a valve timing, and a timing-retard oil passage used for controlling the variable valve timing mechanism to retard the valve timing.

4. The oil passage structure of the valve operating system according to claim 3, wherein oil is supplied to the first oil passage used for controlling the variable valve timing mechanism through a hole formed in the upper bearing.

5. The oil passage structure of the valve operating system according to claim 2, wherein oil is supplied to the first oil passage used for controlling the variable valve timing mechanism through a hole formed in the upper bearing.

6. The oil passage structure of the valve operating system according to claim 1, wherein the first oil passage includes a timing-advance oil passage used for controlling the variable valve timing mechanism to advance a valve timing, and a timing-retard oil passage used for controlling the variable valve timing mechanism to retard the valve timing.

7. The oil passage structure of the valve operating system according to claim 6, wherein oil is supplied to the first oil passage used for controlling the variable valve timing mechanism through a hole formed in the upper bearing.

8. The oil passage structure of the valve operating system according to claim 1, wherein oil is supplied to the first oil passage used for controlling the variable valve timing mechanism through a hole formed in the upper bearing.

* * * * *